United States Patent [19]

Merzals

[11] Patent Number: 4,843,965

[45] Date of Patent: Jul. 4, 1989

[54] THERMALLY ACTIVATED TRIGGERING DEVICE

[75] Inventor: Clarence A. Merzals, Ridgecrest, Calif.

[73] Assignee: The United States of America as represented by the Secretary of the Navy, Washington, D.C.

[21] Appl. No.: 160,787

[22] Filed: Feb. 23, 1988

[51] Int. Cl.[4] ..... F42C 17/00; F42C 19/00

[52] U.S. Cl. ..... 102/205; 102/254

[58] Field of Search ..... 102/205, 207, 221, 222, 102/254, 274

[56] References Cited

U.S. PATENT DOCUMENTS

| | | | |
|---|---|---|---|
| 3,421,443 | 1/1969 | Furlani | 102/205 |
| 3,630,150 | 12/1971 | Rakowsky | 102/205 |
| 3,854,401 | 12/1974 | Fisher | 102/205 |
| 3,956,993 | 5/1976 | Corrado | 102/205 |
| 3,982,488 | 9/1976 | Rakowsky et al. | 102/205 |
| 3,985,058 | 10/1976 | Corrado et al. | 102/205 |
| 3,994,232 | 11/1976 | Rakowsky et al. | 102/205 |
| 4,029,016 | 6/1977 | Cole | 102/254 |
| 4,033,267 | 7/1977 | Morris et al. | 102/205 |
| 4,328,752 | 5/1982 | Jauder | 102/205 |
| 4,709,637 | 12/1987 | Boggero | 102/378 |

*Primary Examiner*—David H. Brown

*Attorney, Agent, or Firm*—William C. Townsend; Melvin J. Sliwka

[57] ABSTRACT

The invention incorporates a thermally responsive rotor, with a primer attached, that revolves to an ignition position upon influence of a temperature rise. Thermally sensitive actuators, also incorporated in the invention, are designed to respond to the temperature rise according to the rate of temperature change. The actuators serve to cock a spring loadable slide. This slide has a firing member nose that is aligned with the primer when the primer and rotor are rotated to the ignition position. At full cocking of the slide, the actuators and slide become disengaged and the slide springs towards the primer. Impact of the slide's nose with the primer causes the primer to be initiated, resulting in a venting or a venting and ignition of an energetic material.

8 Claims, 3 Drawing Sheets

THERMALLY ACTIVATED TRIGGERING DEVICE

BACKGROUND OF THE INVENTION

1. Field of the Invention

The invention pertains generally to ignition devices and systems. More particularly, the invention relates to thermally activated ignition devices and systems. In greater particularity, but without limitation thereto, the invention pertains to an ordnance device that aligns and initiates a triggering primer in response to temperature change.

2. Description of the Prior Art

Energetic materials, such as explosives and propellants, pose the extreme hazard of being inadvertently detonated due to unplanned or accidental stimuli. This hazard is multiplied significantly when these materials are stored in close proximity, as a single unintentional detonation can lead to repetitive, sympathetic detonations. Such unintentional detonations have the potential of destroying not only life and limb, but also the containment structures in which they occur. This potential for destruction is particularly high when these materials are carried aboard oceangoing vessels.

Much work has been done to lessen the possibility of the inadvertent detonation of energetic materials. Sequential explosive initiators or detonators are standard in the art, as are well-thought-through schemes for storing and housing explosive substances. Yet, few advances have been made in safeguarding explosives, propellants or other energetic materials from the effects of heat due to fire.

Members of the art generally concur that two distinct fire environments must be dealt with in order to nullify the potentially disastrous effects of mixing energetic materials with fire. One such environment subjects these materials to a gradual heating over a relatively long period of time, for example, an increase in environmental temperature of six degrees Fahrenheit per hour. This environment has become known as a slow cookoff environment. Another such environment exposes these explosive materials to a rapid heating to elevated temperatures, such as an increase in environmental temperature of 1000 degrees Fahrenheit in 30 seconds with average sustained temperatures of about 1600 degrees Fahrenheit thereafter. This rapid, high temperature condition has become known as a fast cookoff environment. In either of these cases, it is desirable that detonation of the affected materials be avoided, that is, that the materials be rendered inert before detonation temperatures are reached.

SUMMARY OF THE INVENTION

The invention is a triggering device useful in rendering harmless energetic material that would otherwise detonate due to exposure to either the slow or fast cookoff environments. The invention is placed by a casing that typically surrounds the energetic material, and serves to vent the casing or both vent the casing and ignite (burn) the material withing the casing before this material reaches detonation temperature.

The invention incorporates a thermally responsive rotor, with a primer attached, that revolves to an ignition position upon influence of a temperature rise. Thermally sensitive actuators, also incorporated in the invention, are designed to respond to the temperature rise according to the rate at which the temperature changes. The actuators serve to cock a spring loadable firing member slide. This slide has a firing pin nose that is aligned with the primer when the primer and rotor are rotated to the ignition position. At full cocking of the slide, the actuators and slide become disengaged and the slide springs towards the primer. Impact of the slide's nose with the primer causes the primer to be initiated, which in turn initiates actions that result in venting or venting and ignition of the energetic material.

OBJECTS OF THE INVENTION

It is accordingly an object of the invention to provide a temperature sensitive, energetic material triggering device that renders harmless energetic materials on the verge of detonating due to heat.

Another object of the invention is to provide a temperature sensitive triggering device that will respond to a plurality of rates of temperature change.

Another object of the invention is to provide a temperature sensitive triggering device that will cause a casing surrounding an energetic material to be vented.

Yet another object of the invention is to provide a temperature sensitive triggering device that will ignite an energetic material upon being influenced by temperature change.

BRIEF DESCRIPTION OF THE DRAWINGS

Other objects, advantages and novel features of the invention will become apparent from the following detailed description of the invention when considered in conjunction with the accompanying drawings wherein.

DESCRIPTION OF THE PREFERRED EMBODIMENT

Figure 1:
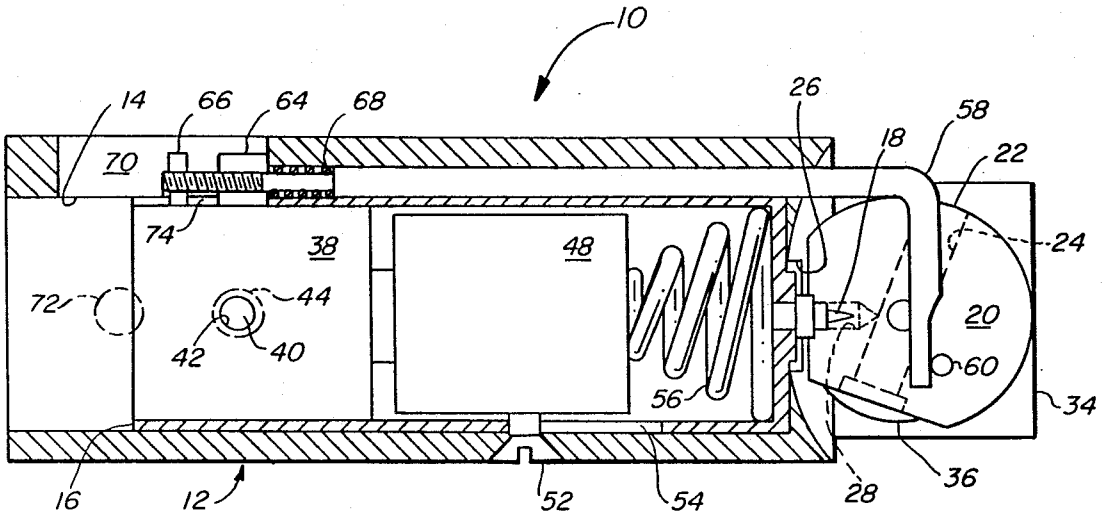
FIG. 1 is a partially sectioned side elevation of the invention shown in a safe position.

Referring to FIG. 1, a thermally activated triggering device of the invention is shown generally at 10. Triggering device 10 has a frame or housing 12 defining a bore 14 in which a firing member slide 16 is slideably disposed for longitudinal movement therein. Slide 16 is essentially hollow and has a closed end upon which a firing pin nose 18 is attached.

Figure 2:
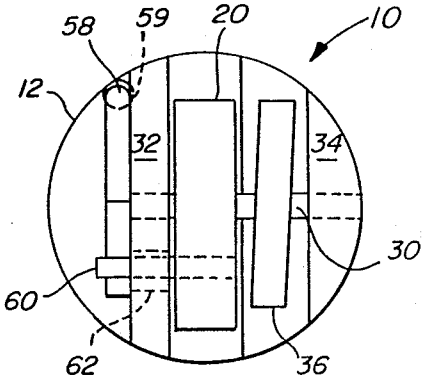
FIG. 2 is an end view of FIG. 1 showing the relationship of the parts.
Figure 3:
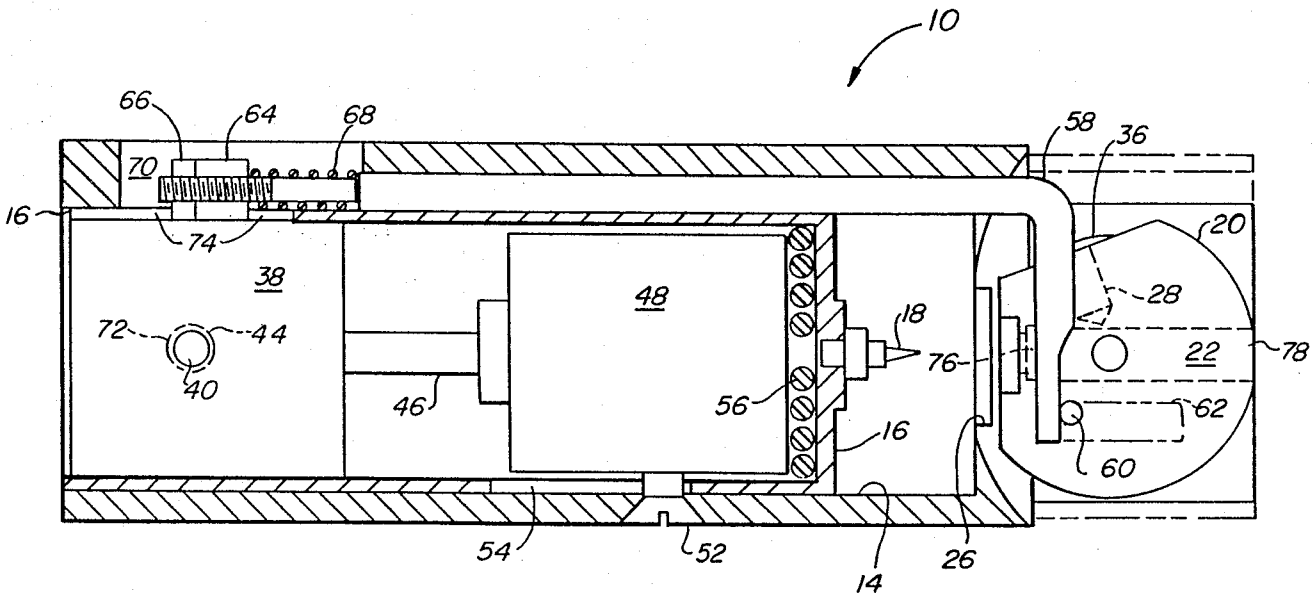
FIG. 3 is a view similar to that of FIG. 1 in which the invention is shown in a firing position.
Figure 4:
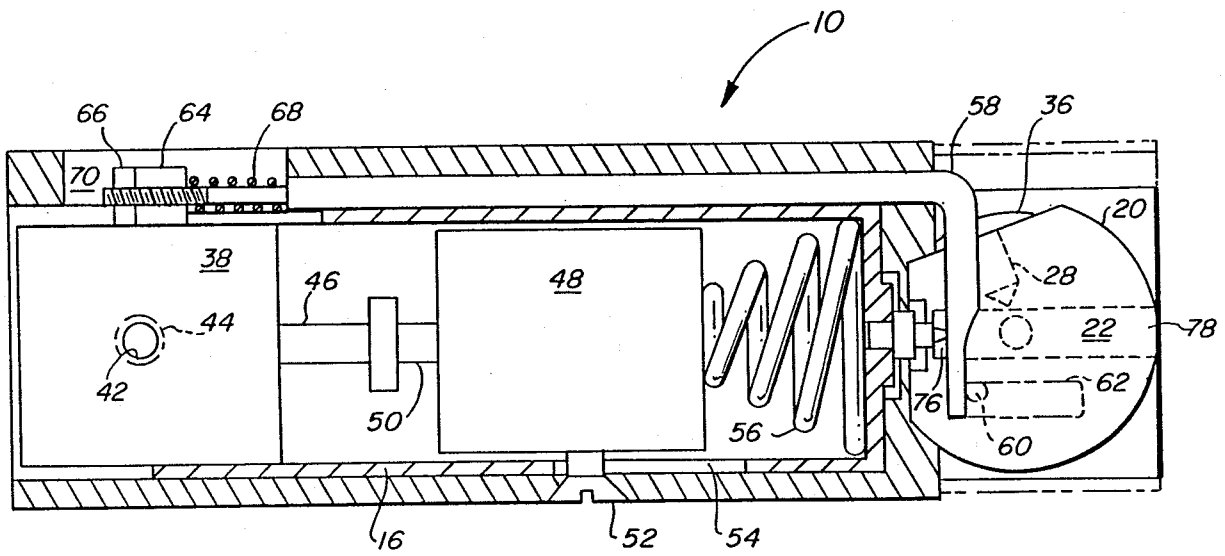
FIG. 4 is a view like that of FIGS. 1 and 3 but in which the invention is shown as having just been fired.

Referring now to both FIGS. 1 and 2, thermally activated device 10 is shown in a safe position. Device 10 additionally has a rotor 20 that is mounted for rotation between a non-ignition position, shown, and an ignition position, as is shown in FIGS. 3 and 4. In the non-ignition position, a primer 22, disposed within a cavity 24 defined by rotor 20, is out-of-line with firing pin nose 18 of firing member slide 16. When device 10 is in the safe position, rotor 20 is in the non-ignition position and firing member slide 16 is in a rest position, characterized by slide 16 resting at a closed end of bore 14. When device 10 is in this safe position, as is shown in FIG. 1, firing pin nose 18 of slide 16 protrudes through an aperture 26 at the closed end of bore 14 to be nestled in a receiving well 28 defined by rotor 20, aperture 26 best shown in FIG. 3. Well 28 serves to protect firing pin nose 18 from damage and serves as a rotor lock in conjunction with nose 18, as rotor 20 cannot rotate while nose 18 is received within this well. When rotor 20 is rotated to the ignition position, shown in FIGS. 3 and 4, primer 22 becomes aligned with firing pin nose 18.

Rotation of rotor 20 is made possible by an integral shaft 30 that is rotatably received within a pair of supporting walls 32 and 34 projecting from one end of housing 12, wall 32 being removed from FIG. 1 for clarity. A coiled temperature responsive biasing element 36, conventional in the thermostat art, engages shaft 30 and housing 12 so that temperature fluctuations affecting the element serve to cause a torque upon shaft 30 and rotor 20 so that rotor 20 can thereby be rotated between the ignition and non-ignition positions.

As can be seen in FIGS. 1, 3 and 4, device 10 also includes a first temperature sensitive actuator 38 that is slideably disposed within slide 16 and that is releasably interlocked with slide 16 by an interlock ball 40 positioned partially within a well 42 defined by actuator 38 and partially within an aperture 44 defined by slide 16 and shown by phantom lines. Ball 40 protrudes through aperture 44 to slide along the interior surface of housing 12. The mechanism for the release of ball 40 will be discussed as the invention is further disclosed.

Actuator 38 contains a heat sensitive expandable and contractible element, such as a wax pellet conventional in the thermostat art, that, when sufficiently heated, expands to cause a plunger 46 to extend from the body of actuator 38, plunger 46 shown best in FIG. 3. Additionally located within slide 16 is a second temperature responsive actuator 48. Second actuator 48 parallels the construction of first actuator 38 in that second actuator 48 also contains an expandable and contractible heat sensitive element, this element causing a plunger 50, shown in FIG. 4, to extend from the actuator when the element is sufficiently heated. Second actuator 48 is dimensioned so as to not directly contact the inner surface of slide 16 and is fastened to housing 12 by conventional fasteners 52, one of which is shown. Fasteners 52 extend through slots 54 defined by slide 16. Slots 54, one of which is shown, ensure that fasteners 52 will not impede the free movement of slide 16 within housing 12.

As can further be seen in the FIGURES, a compressible and expandable energy storage element, such as conical spring 56, is positioned under a slight preload within slide 16 between second actuator 48 and the closed end of slide 16. This preload serves to bias slide 16 to its rest position. Further details of the function of spring 56, as well as other system components, will be explained in the operation discussion of the invention.

In the FIGURES, it can be seen that triggering device 10 includes a rotor indexing rod or member 58 that is slideably disposed within a bore 59 defined by housing 12, bore 59 best shown in FIG. 2. At the rotor end of device 10, indexing rod 58 engages an indexing member 60 that is attached to rotor 20 and that projects from rotor 20 through a window 62 defined by first wall 32, window 62 being shown in FIGS. 2, 3 and 4. In FIGS. 1, 3 and 4, indexing rod 58 can also be seen to engage first actuator 38 by way of a pedestal 64 attached to actuator 38. Rod 58 longitudinally slides within pedestal 64 and is kept from withdrawing therefrom by a nut 66. Device 10 also has a slightly preloaded spring or biasing element 68 fitted around a portion of rod 58 between pedestal 64 and a shoulder of the rod. To prevent pedestal 64 from interfering with the movement of attached actuator 38 and slide 16, a slot 70 is provided in housing 12.

In operation device 10 remains in a safe position, as shown in FIG. 1, until the ambient temperature becomes elevated above a preselected normal environmental level. While in the safe position, actuator plungers 46 and 50 remain fully retracted, slide 16 remains at rest at the rotor end of bore 14 with conical spring 56 being in a relaxed but slightly preloaded condition, rotor 20 rests in the non-ignition position with firing pin nose 18 received within well 28 of rotor 20, and indexing rod 58, due to the biasing effect of spring 68, nudges indexing member 60 attached to rotor 20.

Upon an increase in temperature above a preselected ambient norm, the coiled thermostatic biasing element 36 begins to generate a torque upon rotor 20 in a direction that would tend to rotate rotor 20 towards the ignition position. This movement is initially resisted by indexing rod 58 acting upon indexing member 60 attached to rotor 20. If the ambient temperature increases rapidly, such as in a fast cook-off environment, then the heat sensitive element within actuator 38 will begin to respond. The element responds at or at less than a first preselected rate of temperature change, to cause an extension of plunger 46 of actuator 38 as is shown in FIG. 3.

Referring to FIGS. 1 and 3, as plunger 46 extends, the body of actuator 38 moves away from the stationary second actuator 48. Slide 16, attached to actuator 38 by the interlock 40, moves with the actuator and causes a compression of conical spring 56. Concurrently, nose 18, attached to slide 16, is withdrawn from well 28 of rotor 20. Rotor 20 initially remains in the non-ignition position due to the preloading effect of spring 68 acting upon indexing rod 58. This preloading of spring 68 is designed to allow nose 18 to be fully withdrawn from rotor 20 before rotor 20 is permitted to rotate.

Further extension of plunger 46 of actuator 38 results in a gradual unloading of spring 68 and a gradual loading of conical spring 56. Yet further extension of plunger 46 causes pedestal 64, attached to actuator 38, to interface with nut 66 at the end of indexing rod 58, thereby causing rod 58 to move away from indexing member 60 attached to rotor 20 so that rotor 20 is free to rotate toward the ignition position. If the ambient environment maintains fast cook-off conditions, rotation of rotor 20 will progress towards the ignition position and movement of slide 16 will continue, causing conical spring 56 to be substantially compressed. When slide 16 achieves a firing position, as is shown in FIG. 3, rotor 20 will have fully rotated to the ignition position. Interlock 40 then escapes from its captive state through an aperture 72 in the periphery of housing 12. This release of interlock 40 permits slide 16 to spring free of actuator 38. A slot 74 in slide 16 provides an unobstructed path for slide 16 to move free of pedestal 64. Conical spring 56 is thus rapidly unloaded to thrust nose 18, attached to slide 16, into an exposed section 76 of impact sensitive primer 22, primer 22 having now been aligned with the nose 18 by full rotation of rotor 20 to the ignition position. The stored detonation energy or detonation/incendiary energy within now initiated primer 22 is directed through a second exposed section 78 of the primer away from device 10 to initiate actions that result in venting or venting and ignition of an energetic material.

The fired position of device 10 is shown in FIG. 4. Though FIG. 4 shows both plungers 46 and 50 being extended, in the fast cook-off mode only plunger 46 of actuator 38 is designed to operate. Cooperation of the two plungers, as shown, takes place in another mode next to be discussed.

In the event that the ambient temperature rises more gradually than in a fast cook-off environment, the device is also designed to respond to a less rapid temperature rise, such as would be encountered in a slow cook-off environment.

Referring to FIGS. 1, 3 and 4, operation of device 10 in a slow cook-off environment would closely parallel the operation of the device under fast cook-off conditions, except that actuation of second actuator 48 would also come into play.

Second actuator 48 is designed to respond to at most a second preselected rate of temperature change that is less than the higher, first preselected rate of temperature change at which first actuator 38 responds.

Second actuator 48 does not timely respond under the more intense fast cook-off conditions because the actuator is engineered to absorb a minimum of heat transfer during the fast cook-off state. Actuator 48 is suspended within slide 16 so that a minimum heat conductive path is created for the flow of heat from housing 12. In contrast, first actuator 38 is in direct contact with slide 16 to provide a direct thermal path to housing 12. This enables first actuator 38 to timely respond to both fast and slow cook-off conditions.

Under slow cook-off conditions, actuators 38 and 48 simultaneously react. Referring to FIG. 4, where device 10 is shown in a fired position, it can be seen that there is an extension of plunger 46 of first actuator 38 combined with an extension of plunger 50 of second actuator 48. This cooperation of the two actuators permits a firing or full actuation of device 10 at an environmental temperature lower than that at which the device would fire under fast cook-off conditions.

If either of the above cook-off conditions are not sufficiently lengthy for full actuation of the device to take place, then initiation of the energetic material will not occur. Plungers 46 and 50 can then retract from partial extension into their respective housings, this retraction causing indexing rod 58 to urge rotor 20 back to the non-ignition position so that nose 18 enters well 28 of rotor 20 undamaged and ready to be utilized as the case may be.

An important safety feature of device 10 is that the device will not fire unless both the thermally responsive biasing element attached to the rotor and one or both of the actuators respond to environmental temperatures. A malfunction of either the rotor biasing element or one or both of the actuators will not cause device 10 to fire.

When properly placed by an energetic material, device 10 can serve to prevent detonation of the energetic material before this material reaches detonation temperatures. The combination of two temperature sensitive actuators permits the device to fire at diverse temperatures, these temperatures being based upon whether the device is exposed to a rapid rate of temperature change, as would be encountered in a fast cook-off environment, or to a less rapid rate of temperature change, as would be encountered in a slow cook-off environment. This combination, importantly, permits the device to fire anywhere between these two cook-off extremes, as the actuators will react proportionally to the temperature rise.

It should be noted that, with a minimum of modification, the triggering device of the invention can be tailored to fit the specific heating response characteristics of a great many energetic materials. Such modifications could involve varying the number of actuators, the type and amount of heat sensitive material within the actuators, the travel of the actuator's plungers, and/or the amount of insulation surrounding the actuators.

Device 10 has been described in specific detail in order to enable one skilled in the applicable arts to make and use the device, but such detail is not intended to limit or restrict the invention, but is instead to serve as example. Within good engineering principles numerous adaptations and modifications of the invention are possible.

One such adaptation would be to attach the device directly to an energetic material. The material could then be ignited before detonation temperatures were reached. A modification of the invention, by way of example, would be to incorporate a primer of significant strength so that actuation thereof results in detonating an energetic material. Further, there is no reason to limit the device to energetic material applications, as the device could be fitted to any triggering/initiating application where heat rate sensing is required in conjunction with varying firing temperatures.

It should therefore be understood that, within the scope of the appended claims, the invention may be practiced other than as has been specifically described.

What is claimed is:

1. A thermally activated triggering device having an impact reactive primer, the device comprising:

a frame, said primer being mounted to said frame;

firing member means mounted to said frame for transmitting force to said primer, said firing member means being moveable between a rest position and a firing position;

resilient force transmission means engaging said firing member means and said frame for urging said firing member means towards said rest position;

temperature sensitive actuator means engaging said firing member means and said frame, said temperature sensitive actuator means for moving said firing member means between said rest position and said firing position in response to temperature change;

releasable interlock means releasably interlocking said firing member means with said temperature sensitive actuator means for releasing said firing member means from said temperature sensitive actuator means in response to said firing member means moving to said firing position;

so that in response to positive temperature change said temperature sensitive actuator moves said firing member means towards said firing position thereby loading said resilient force transmission means and so that in response to said firing member means reaching said firing position said releasable interlock means releases said firing member means to thereby rapidly unload said resilient force transmission means to thrust said firing member means into forceable contact with said primer to release energy stored within said primer.

2. The thermally activated device of claim 1 in which said temperature sensitive actuator means comprises:

a first temperature sensitive actuator being reactable in response to at most a first rate of temperature change; and a second temperature sensitive actuator being reactable in response to at most a second rate of temperature change, said second rate of temperature change being less than said first rate of temperature change, so that in response to positive temperature change above said second rate of temperature change and equal to and below said first rate of temperature change said first temperature sensitive actuator individually urges said firing member means from said rest position towards said firing position, and so that in response to positive temperature change equal to and below said second rate of temperature change said first and second temperature sensitive actuators jointly urge said firing member means from said rest position towards said firing position.

3. A thermally activated triggering device having a primer, the device comprising:

a frame;

temperature responsive means attached between said frame and said primer for rotating said primer between a non-ignition position and an ignition position; and primer initiating means attached to said frame for impacting said primer when said primer is in said ignition position.

4. The thermally activated device of claim 3 in which said primer is reactive to impact.

5. The thermally activated device of claim 4 in which said primer initiating means comprises:

a firing pin member moveable between a rest position and a firing position;

a compressible and expandable energy storage element engaging said firing pin member and said frame for urging said firing pin member towards said rest position;

a first temperature sensitive actuator engaging said firing pin member and said frame for moving said firing pin member between said rest position and said firing position in response to at most a first rate of temperature change;

a second temperature sensitive actuator engaging said firing pin member and said frame for moving said firing pin member between said rest position and said firing position in response to at most a second rate of temperature change, said second rate of temperature change being less than said first rate of temperature change, where in response to positive temperature change above said second rate of temperature change and equal to and below said first rate of temperature change said first temperature sensitive actuator individually urges said firing pin member from said rest position towards said firing position, and where in response to positive temperature change equal to and below said second rate of temperature change said first and second temperature sensitive actuators jointly urge said firing pin member from said rest position towards said firing position; and a releasable interlock interlockably engaging said firing pin member and said actuators, said releasable interlock releasing said firing pin member from said actuators in response to said firing pin member moving to said firing position;

so that in response to positive temperature change said firing pin member moves towards said firing position thereby loading said compressible and expandable energy storage element and so that in response to said firing pin member reaching said firing position said releasable interlock releases said firing pin member to thereby rapidly unload said compressible and expandable energy storage element to thrust said firing pin member into forceable contact with said primer to release energy stored within said primer.

6. A thermally activated triggering device having an impact reactive primer, the device comprising:

a frame;

a rotor mounted to said frame for rotation between a non-ignition position and an ignition position, said primer being attached to said rotor so that at least two sections of said primer are exposed;

a temperature responsive biasing element being engaged with said frame and said rotor for biasing said rotor between said non-ignition position and said ignition position in response to temperature;

a slide mounted to said frame for translational movement between a rest position and a firing position, said slide having a firing pin nose for transmitting force to said primer at one of said exposed sections, said one of said exposed sections of said primer being aligned with said nose of said slide when said rotor is in said ignition position;

a compressible and expandable energy storage element engaging said slide and said frame for urging said slide towards said rest position;

an expandable and contractible temperature sensitive actuator engaging said frame and engaging said slide, said temperature sensitive actuator for moving said slide between said rest position and said firing position in response to at most a preselected rate of temperature change; and a releasable interlock interlockably engaging said slide and said actuator, said interlock releasing said slide from said actuator in response to said slide moving to said firing position;

so that in response to positive temperature change said rotor is rotated to said ignition position and said slide is urged by said actuator and in opposition to said compressible and expandable energy storage element towards said firing position where said interlock releases said slide from said actuator so that said firing pin nose of said slide forceably engages said one of said exposed sections of said primer to initiate said primer to direct energy within said primer through a second of said exposed sections of said primer and from said triggering device.

7. The thermally activated device of claim 6 further comprising:

a second expandable and contractible temperature sensitive actuator engaging said frame and said slide, said second actuator for moving said slide between said rest position and said firing position in response to at most a second preselected rate of temperature change, said second preselected rate of temperature change being less that said a preselected rate of temperature change, where in response to positive temperature change above said second preselected rate of temperature change and equal to and below said a preselected rate of temperature change said an expandable and contractible temperature sensitive actuator individually urges said slide from said rest position towards said firing position, and where in response to positive temperature change equal to and below said second preselected rate of temperature change said an and said second expandable and contractible temperature sensitive actuators jointly urge said slide from said rest position towards said firing position.

8. The thermally activated device of claim 6 further comprising:

an indexing member engaging said an expandable and contractible temperature sensitive actuator and engaging said rotor so that said rotor is precluded from rotating to said ignition position if said actuator does not respond to temperature change.

* * * * *